United States Patent [19]

Jones et al.

[11] 4,297,947

[45] Nov. 3, 1981

[54] ELECTRIC IGNITER

[75] Inventors: Eirwyn Jones, Alloway, Scotland; Michael I. Mitchell, Runcorn, England

[73] Assignee: Imperial Chemical Industries Limited, Millbank, England

[21] Appl. No.: 39,443

[22] Filed: May 15, 1979

[30] Foreign Application Priority Data

May 24, 1978 [GB] United Kingdom ..... 21735/78

[51] Int. Cl.[3] ..... F42C 11/00

[52] U.S. Cl. ..... 361/248; 102/206; 102/202.9; 29/611

[58] Field of Search ..... 102/28 R, 28 P, 28 S, 102/28 A, 28 M, 28 E, 28 W, 28 B, 203; 361/248

[56] References Cited

U.S. PATENT DOCUMENTS 4,141,297 2/1979 Sellwood ..... 361/248

OTHER PUBLICATIONS

Blasting Practice published by ICI-Nobels Explosive Company Limited (Kynoch 1972), pp. 25-27.

*Primary Examiner*—Donald P. Walsh
*Attorney, Agent, or Firm*—Larry S. Nixon

[57] ABSTRACT

An ignition system for the firing of a plurality of electrically actuable igniters (16) and methods for construction and use of the assembly. The ignition leading wire (17) of each electrically actuable igniter (16) is formed from a continuous length of insulated wire connecting its two electrical connection terminals. The leading wire is looped around a transformer core (14) having a movable portion (15) that is opened to admit the loop. A firing cable (12) coupled to a source of electrical firing energy (11) is also looped around the transformer core completing the formation of a transformer for coupling electrical firing energy from the source to each of the igniters to be fired. A plurality of transformer cores can be coupled to a single firing energy source by looping a continuous wire from the source, through each transformer and then back to the source, thereby electromagnetically coupling firing energy to each transformer. In an alternate configuration, the igniter leading wires (17) are each loop coupled to a toroidal core (20) which is in turn electromagnetically coupled to a transformer (19) by a single loop of insulated wire looped through the core of the transformer and each toroidal core. The construction method includes connecting the two ends of a continuous length of insulated wire (17) to the two electrical connection terminals of each igniter (16) to be fired, or further including the looping of each continuous length of insulated wire (17) from an igniter around a toroidal core (20) to form an ignition assembly for coupling to a transformer (19) just prior to firing of the igniters. The method for use of the ignition assembly includes either the looping of the continuous wire (17) connected to each igniter around the transformer (14) having a movable portion (15) or coupling the toroidal cores (20) to a transformer (19) so that firing energy can be transferred from the source of electrical firing energy (11) to the igniters (16) to be fired.

45 Claims, 3 Drawing Figures

ELECTRIC IGNITER

RELATED APPLICATIONS

The subject matter of this application is related to the subject matter of co-pending, commonly assigned U.S. application Ser. No. 4,265—Stratton, filed Feb. 1, 1978 and Ser. No. 109,109—Jones filed Jan. 15, 1979.

BACKGROUND OF THE INVENTION

This invention relates to ignition systems for the firing of electrically actuable igniters of the type used as electric fuseheads in blasting detonators and for the igniting of incendiary charges in pyrotechnic devices. Specifically, this invention relates to an ignition system for the firing of such electrically actuable igniters and to methods for assembling such systems and to methods for firing electrically actuable igniters.

Electrically actuable igniters generally include a resistive electric ignition element having two electrical connection terminals. A two conductor igniter leading wire is usually connected to these two electrical connection terminals so that just prior to use, the two conductor igniter leading wire can be connected to a source of firing energy. The resistive electric ignition element is a conducting composition that is electrically heated to an ignition point or includes a bridge wire element having a predetermined resistance for generating heat in thermal contact with an incendiary composition. The construction and use of electrically actuable igniters commonly used as the fuseheads of blasting detonators are described and illustrated in *Blasting Practice* published by ICI-Nobels Explosive Company Limited (Kynoch 1972), Chapters 2 and 3.

In the igniter discussed, the resistive electric ignition element includes a bridge wire that is metallurgically bonded across the pair of metal electrodes, to which ignition leading wires are also bonded. The electrodes are embedded in an incendiary composition. The igniter leading wires are 0.51–1.22 mm. in diameter copper or iron wires insulated with a synthetic plastic material such as polyvinyl chloride.

Specifically, three groups of resistive electric ignition elements having different sensitivities have been developed for electric detonators:

Group 1 ignition elements have a characteristic resistance of 0.9–1.6 ohms and a firing sensitivity in the range of 3–5 millijoules/ohms;

Group 2 ignition elements have a characteristic resistance of 0.15–0.18 ohms and a firing sensitivity in the range of 80–140 millijoules/ohms; and Group 3 ignition elements have a characteristic resistance of 0.02–0.04 ohm and a firing sensitivity in the range of 1,000–2,500 millijoules/ohms.

Commercial electric detonators are generally supplied with two separate leading wires which, to facilitate later connection to a source of firing energy are barred to a length of about 1 cm. at their unconnected ends. In use, it is understood that the barred ends of the leading wires are connected by twisting a barred end of a leading wire from one ignition element with a barred wire end form another igniter to connect the igniters in series, parallel or series-parallel arrangement to the source of electrical firing energy. In many cases igniters arrive from a manufacturer with the two barred wire ends from each igniter twisted together and sheathed by the manufacturer as a safeguard against extraneous electrical sources. In these cases, the barred ends have to be separated by the user.

When the wires are unsheathed the detonator is subject to the risk of accidental ignition by extraneous electrical energy sources such as an electrostatic discharge from a person or from a substance in close proximity to the igniter such as pneumatically loaded ammonium nitrate fuel oil explosive (ANFO), a stray current from a battery or electric line, or a stray galvanic current. In addition to this serious safety problem, the use of these commercially available igniters is highly inconvenient. The actual connection of the leading wires is tedious, difficult and time consumming, especially for parallel or series-parallel circuits. Connections must often be made in the poor light and confined space of an underground mine or tunnel. In such an environment, there is always the possibility of a faulty connection or of bare wire connections coming into contact with water or other good earth leakage contact prior to the intended firing of the igniters.

Various arrangements have been attempted to protect igniters from stray current and reduce the safety hazard. Igniters have been coupled to a firing circuit through a transformer core and, in some igniters assemblies designed for military use, the cores of the transformers have been separable into two parts to allow the primary and secondary circuits to be kept separate until assembly was required for firing. Then, the assembly was armed for use by coupling the transformer core portions to one another. In these military igniter assemblies the transformer windings were separate from the leading wires of the igniter and also separate from the firing cable coupled to the power supply. If used with a commercial igniter the transformer windings would have to be connected to the firing cable and to the igniter leading wires manually. Such a situation remains unsatisfactory.

SUMMARY OF THE INVENTION

It is therefore the primary object of the present invention to provide an ignition system for firing one or more electrically actuable igniters that is safe to use, and to provide methods for the construction and use of such ignition systems. The present invention provides an ignition assembly wherein wire-to-wire connections are eliminated and wherein external leading wires are insulated at all times.

The insulated leading wires from a commercially available electrically actuable igniter or the leading wires from a source of electrical firing energy are used to form a winding of a transformer electromagnetically coupling the electrically actuable igniter to the source of electrical firing energy. This arrangement eliminates the need for any wire-to-wire connections to transformer windings and eliminates the need for wire-to-wire connections between leading wires. It further provides protection of the igniter against the hazard of an inadvertent and unintended firing from extraneous sources of firing energy. Adequate coupling is readily achieved even with a single loop of leading wire loosely threaded through the core of a ring core transformer.

Specifically, the ignition system according to the present invention includes an electrically actuable igniter, an electrical supply providing a source of firing energy, a transformer having a transformer core providing a closed magnetic circuit, and leading wires from the electrical supply (firing cable) and the igniter respectively coupled through the transformer, an insulated portion of the leading wires being looped through the transformer core to form at least part of the transformer winding. The insulation of the leading wires is continuous over the entire length of the wires in order to avoid accidental contact with extraneous electrical sources.

In a first embodiment of the ignition system, shown in FIG. 1, looping of the insulated leading wires from a plurality of igniters and the electrical supply (firing cable) is facilitated by the opening of the transformer core via a movable portion thereof. This arrangement permits the use of continuous leading wires thereby avoiding the need for intermediate wire-to-wire connection. Thus, the igniter leading wires are formed from a single continuous insulated wire whose end are respectively electrically coupled to the two electrical connection terminals of an igniter element and having a loop intermediate its ends. This combination of an igniter electrically coupled to a continuous length of insulated wire forming an intermediate loop forms an ignition assembly. The intermediate loop of this ignition assembly is looped into an openable transformer core to which the electrical supply leading wires are also coupled.

Several igniter elements can be simultaneously and conveniently coupled to the same transformer core and ignited by a single signal from the electrical supply. Such a parallel arrangement of igniters is particularly advantageous in multi-shot blasting as it avoids the usual problem of detonator lag time variation, which can cause misfires with series connected igniters, and the problem of circuit balancing in parallel connected circuits.

In a second embodiment, shown in FIG. 2, an ignition assembly is formed by looping the continuous length of igniter leading wires through a toroidal core. A plurality of such toroidal cores are then electromagnetically coupled to a transformer core by a single loop of insulated wire passed through each toroidal core and the transformer core.

In a third ignition system embodiment, shown in FIG. 3, the firing cable form a source of electrical firing energy is a single, continuous, insulated wire whose ends are electrically coupled to the electrical supply terminals, an intermediate portion of this cable being looped into the transformer core to which an igniter leading wire is also coupled. There may be more than one transformer coupled in series between the electrical supply and the igniter and, an extending link of insulated leading wire similar to the igniter leading wire may be used to couple the primary and secondary of two transformers to which the igniter and supply leading wires are respectively coupled. With such an arrangement one of the transformers coupled to the igniter may be expendable and placed close to an igniter in a blasting charge.

The present invention also provides a method for constructing two ignition assembly arrangements for the safe and convenient firing of electrically actuable igniters. The construction method includes electrically coupling the two ends of a continuous length of insulated igniter leading wire, folded back on itself, to the two electrical connection terminals of an igniter. A loop is formed at the doubled back end for slipping this end over an opened transformer core.

An alternate construction method includes looping the continuous length of insulated igniter leading wire about toroidal core before being electrically connected to the two electrical connection terminals of an igniter. The toroidal core is in turn electromagnetically coupled for firing.

The present invention further provides a method for firing an electrically actuable igniter wherein leading wires from an igniter are coupled to the firing cable from a source of electrical firing energy through a transformer having a core providing a closed magnetic circuit. At least a portion of the windings of the transformer includes an insulated portion of the leading wires from the igniter and/or the electrical supply looped into the magnetic circuit.

The ignition system and methods of the present invention provide a marked improvement in safety from the effects of extraneous electrical sources and leakage currents. The assembly may be readily designed to protect against accidental electrostatic discharge, direct current and low frequency alternating sources. It has been found, for example, that with a single loop coupling of igniter leading wires to the transformer, provided the leading wires are at least six meters in total length, the protection obtained against high voltage discharges from small capacitors ($2000\times10^{-12}$ Farad) is such that adequate safety against electrostatic discharge from persons and from ANFO explosive is ensured.

The ignition systems and construction and firing methods according to the present invention solve the long standing safety problem associated with the firing of conventional electrically actuable igniters. There is no longer a need to unsheath the leading wire coupled to an electrically actuable igniter exposing the user to risk of accidental ignition by an extraneous electrical source such as an electrostatic discharge from a person or from a neighboring substance. In addition the utilization of the arrangement disclosed minimizes the tedious connection of wires required by conventional arrangements. The firing system according to the present invention can be utilized in poor light conditions and in the confined space of an underground mine or tunnel. There is virtually no risk of inadvertent connection or coupling to environmental water or other sources of inadvertent firing energy. The use of a transformer core having a movable portion particularly simplifies the integration of all components into a total system suitable for firing a plurality of electrically actuable igniters.

Insulated leading wires from a commercially available igniter or from a firing unit are advantageously utilized as the windings of a transformer coupling the igniters to a source of electrical firing energy. This arrangement eliminates the requirements for any connection to transformer windings or between the leading wires and provides added protection by isolating the igniters from sources of stray firing energy. Adequate electromagnetic coupling is readily obtained even with a single loop of leading wire loosely threaded through a ring-core transformer.

THE BRIEF DESCRIPTION OF THE DRAWINGS

Many of the attendant advantages of the present invention will be readily apparent as the invention becomes better understood by reference to the following detailed description with the appended claims, when considered in conjunction with the accompanying drawings, wherein:

DESCRIPTION OF THE PREFERRED EMBODIMENTS

Figure 1:
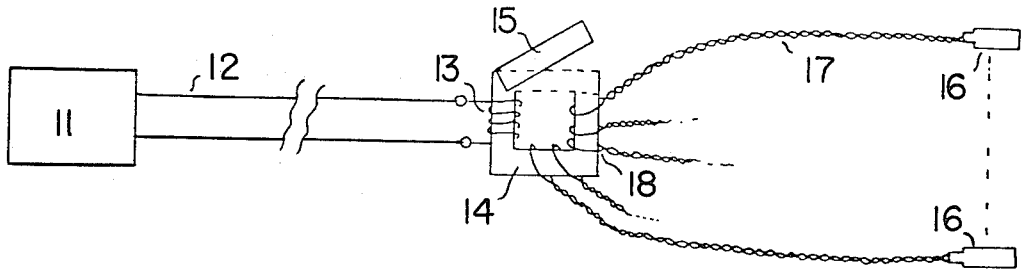
FIG. 1 is a diagrammatic representation of a first embodiment of the ignition system according to the present invention.

Referring now to the figures wherein like reference numerals designate like or corresponding parts throughout, and specifically referring to FIG. 1, there is shown a first embodiment of the ignition system according to the present invention. A firing unit 11 provides a source of electrical firing energy for the actuation of a plurality of resistive electric ignition elements 16 (electrically actuable igniters). Electrical energy from firing unit 11 is electrically coupled into a firing cable 12 which is in turn electrically coupled to the ends of a primary winding 13 wound about a transformer ring-core 14. Ideally, transformer ring-core 14 has a rectangular shape and a movable portion 15 that is movable to permit the transformer ring core to be temporarily opened as shown by the solid and dotted lines in the FIG. 1.

The two electrical connection terminals of each resistive electric ignition element 16 are coupled to an ignition leading wire 17 which is a continuous length of insulated electrically conductive wire. Igniter leading wire 17, since it is a continuous wire, includes a loop end which is looped over transformer ring-core 14 through the opening created by the manipulation of movable portion 15 of the transformer ring-core. By looping the loop end of igniter leading wire 17 around transformer ring-core 14, a secondary transformer winding 18 is created which electromagnetically couples each igniter leading wire to the transformer ring-core. The ignition system is ready for firing when movable portion 15 of transformer ring-core 14 is closed into the position illustrated by the dotted lines in the FIG. 1. The closing of movable portion 15 completes the magnetic circuit of transformer ring-core 14 so that primary winding 13 and looped secondary windings 18 are electromagnetically coupled to one another. Ignition elements 16 are fired simultaneously when a firing signal is generated within firing unit 11.

In accordance with the embodiment of the ignition system diagrammatically represented in FIG. 1, a method for firing resistive electric ignition elements 16 is defined including the following steps:

electrically connecting the two electrically connection terminals of a resistive electric ignition element 16 to an igniter leading wiring 17 which is a continuously length of insulated electrically conductive wire;

electromagnetically coupling igniter leading wire 17 to transformer ring-core 14 by looping the loop end of the igniter leading wire around the transformer ring-core; and electromagnetically coupling transformer ring-core 14 to a firing unit which is a source of electrically firing energy for actuating ignition elements 16.

The heart of the ignition system shown in FIG. 1 is an ignition assembly constructed by:

electrically coupling the two ends of a continuous length of wire to the two terminal of an electrically actuable igniter; and forming a loop in the continuous length of wire.

The loop thus formed is slipped over transformer ring-core 14 just prior to the desired firing of the igniter.

By way of nonlimitive example, firing unit 11 includes a signal generator having an output frequency of 10 kHz. coupled to and driving a 25-watt power amplifier having an output stage suitable for working into a 16-ohm load resistance. The amplifier output is fed directly into a 100-meter long twin core firing cable 12 in which each core of the cable includes 7 strands of 0.4 mm. diameter copper wire and is insulated to 3.1 mm. diameter using polyvinyl chloride, the total resistance of the firing cable being 4 ohms. Transformer ring-core 14 is a high permeability ferrite material formed in the shape of a rectangle having outside dimension 6.3 cm.×5.7 cm. and having cross-sectional dimensions of 13 mm.×13 mm. Primary winding 13 of transformer ring-core 14 includes 12 turns of 0.61 mm. diameter copper wire insulated to an outside diameter of 1.14 mm. using polyvinyl chloride. Ignition elements 16 are incorporated into fusehead detonators sensitive to a firing impulse of 3 to 5 millijoules/ohms and/or fitted with 5-meter long twin igniter leading wires 17. Igniter leading wires 17 utilized the same wire that is used to form primary winding 13 of transformer ring-core 14. Igniter leading wires 17 terminate enclosed, fully insulated loops which form secondary transformer windings 18 of transformer ring-core 14. Thirty detonators were simultaneously fired by a single signal from firing unit 11.

Figure 2:
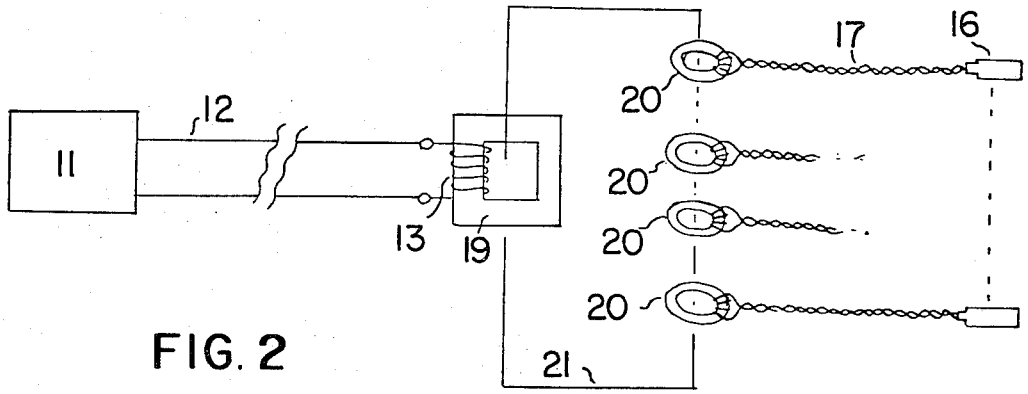
FIG. 2 is a diagrammatic representation of a second embodiment of the ignition system according to the present invention.

Referring now to FIG. 2 which is a diagrammatic representation second embodiment of the ignition system according to the present invention, again there is shown a plurality of resistive electric ignition elements 16 to be actuated by a signal from firing unit 11.

Firing unit 11 is again coupled by firing cable 12 to primary winding 13 of a transformer. In this embodiment, however, the transformer windings are wound about a transformer ring-core 19 having no movable portions. Transformer ring-core 19 is a continuous ring of ferromagnetic material. Again, the two electrical connection terminals of each of resistive electric ignition elements 16 are coupled to the two ends of igniter leading wire 17 that is continuous length of electrically conductive wire. In this embodiment, instead of the loop end of igniter leading wire 17 being wrapped as a secondary transformer winding 18 around transformer ring-core 14 having a movable portion 15, the loop end of the igniter leading wire from each ignition elements is electromagnetically coupled to a toroidal transformer core 20. This electromagnetic coupling is accomplished by winding several turns of the loop end of igniter leading wire 17 around toroidal transformer core 20. Toroidal transformer cores 20 are in turn electromagnetically coupled to transformer ring-core 19 by a single loop of insulated wire 21 passing through each toroid to be coupled and passing through the transformer ring-core. This electromagnetic coupling between toroidal transformer core 20 and transformer ring-core 19 can be accomplished just prior to firing of ignition elements 16 in the field.

In the arrangement represented in FIG. 2, the following method of firing actuates resistive electric ignition elements 16: Firing unit 11 generates a source of electrical firing energy which is electromagnetically coupled to transformer ring-core 19 via firing cable 12 and primary winding 13. The changing magnet flux induced within transformer ring-core 19 electromagnetically couples an electrical signal to loop 21 of insulated wire passing through toroidal transformer cores 20. By virtue of the electromagnetic coupling between loop 21 and toroidal transformer cores 20, a magnetic flux is induced within each of the toroids. The electromagnetic coupling between toroidal transformer cores 20 and igniter leading wires 17 induce an electrical signal within the igniter leading wire which in turn actuates resistive electric ignition elements 16.

In essence, the firing method includes the steps of:

electrically connecting the two electrical connection terminals of the resistive electric ignition element to the two ends of a continuous length of insulated electrically conductive wire;

electromagnetically coupling the continuous length of wire to an ignition assembly magnetically permeable core;

electromagnetically coupling the ignition assembly magnetically permeable core to a transformer core; and electromagnetically coupling the transformer core to a source of electrical firing energy.

The arrangement shown in FIG. 2 allows for the construction of ignition assemblies each including a resistive electric ignition element 16, and igniter leading wire 17, and a toroidal transformer core 20. Igniter leading wire 17, being a continuous length of electrically conductive wire, is looped several turns around a toroidal transformer core 20. Its two ends are electrically connected to the two electrically connection terminals of an ignition element 16. In this manner, an ignition assembly is constructed for easy and safe use in the field in order to utilize the ignition assembly so constructed, the user need only pass a single loop of insulated wire 21 through each of the toroidal transformer cores 20 of such an ignition assembly to be fired. This loop 21 of insulated wire is then linked through transformer ring-core 19 and ignition element 16 are ready for firing.

In essence, the construction method includes the steps of:

looping a continuous length of insulated wire about a toroidal core; and electrically coupling the two ends of the insulated wire to the two electrical connection terminals of the electrically actuable igniter.

By means of specific nonlimitive example, one particular arrangement as shown in FIG. 2 is constructed as follows: resistive electric ignition elements 16 are arranged as shown. Firing unit 11 includes a signal generator having an output frequency of 10 kHz. driving a 25-watt power amplifier designed to work into a 16-ohm load. The amplifier output is coupled directly to a 100-meter long twin core firing cable 12 in which each core consists of 7 strands of 0.4 mm. diameter copper wire and is insulated to a total diameter of 3.1 mm. using polyvinyl chloride, the total resistance of the firing cable being 4 ohms. Transformer ring-core 19 is a continuous rectangle of high permeability ferrite material having outside dimension 6.3 cm.×5.7 cm. and cross-sectional dimension of 13 mm.×13 mm. Primary winding 13 consists of 12 turns of 0.61 mm. diameter copper wire coated to an outside diameter of 1.14 mm. with polyvinyl chloride. Toroidal transformer cores 20 are high permeability ferrite material each having an outside diameter of 2.5 cm. and a cross-sectional area of 15 $mm^2$. Ignition leading wires 17 are constructed from the same wire utilized in primary winding 13 and are looped five times around toroidal transformer cores 20. Loop 21 is a one meter length of 0.61 mm. diameter copper insulated with polyvinyl chloride to an outside diameter of 1.14 mm. The ignition elements 16 were fired simultaneously from a single signal from power unit 11 using this configuration.

Figure 3:
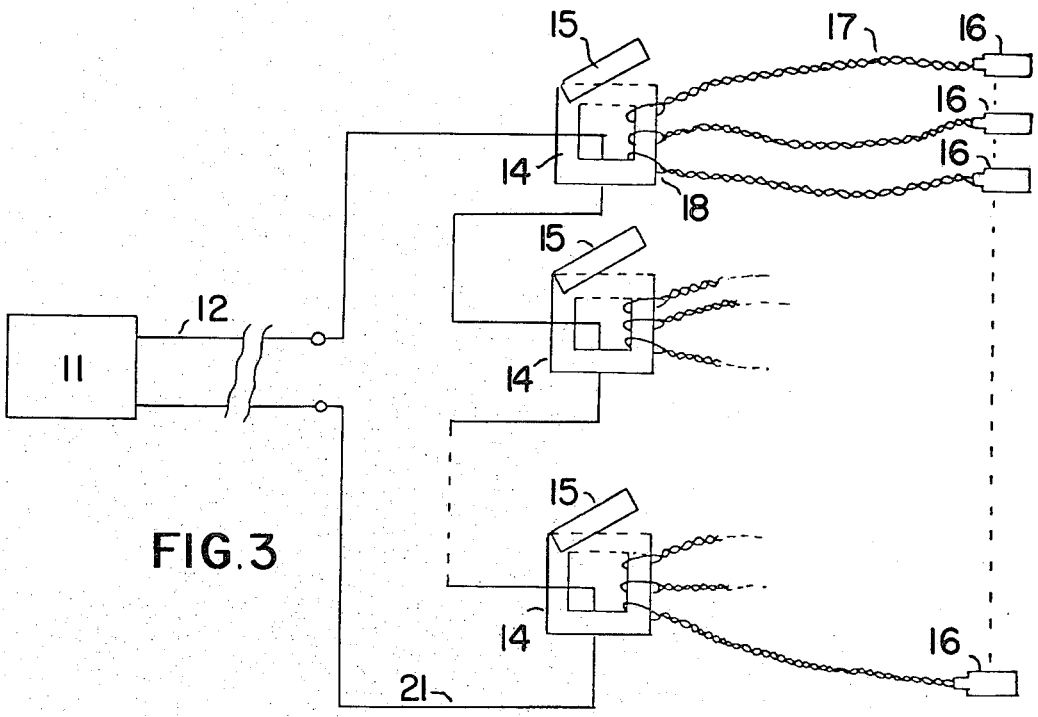
FIG. 3 is a third embodiment of the ignition system according to the present invention.

Referring now to FIG. 3 which is a diagrammatic representation of a third embodiment of the ignition system according to the present invention, again, the object is to fire a plurality of resistive electric ignition elements 16 from a firing signal generated by firing unit 11. As in the embodiment shown in FIG. 1, a plurality of ignition assemblies, each including an ignition element 16, and an igniter leading wire 17 are electromagnetically coupled to transformer ring-core 14 having a movable portion 15. The loop end of igniter leading wire 17 forms a secondary transformer winding 18 so that magnetic flux within transformer ring-core 14 induces an electrical signal within igniter leading wire 17. Also, in a similar fashion to the arrangement illustrated in FIG. 1, firing unit 11, generates a firing signal coupled into firing cable 12. However, in this embodiment, firing cable 12 is coupled across both ends of a loop 32 of insulated wire passing through each of a plurality of transformer ring-cores 14. Each such transformer ring-core 14 includes a group of ignition assemblies electromagnetically coupled thereto as secondary windings. Loop 22, in essence, forms a primary winding having one turn only on each of transformer ring-core 13.

The firing method defined by the arrangement shown in FIG. 3 is as follows: firing unit 11 generates a firing signal coupled to loop 22 by firing cable 12. Loop 22, passing through each of a plurality of transformer cores 14, functions as primary winding of each of the transformer cores and induces a magnetic flux by virtue of its electromagnetic coupling with each such core. The changing magnetic flux within each of transformer cores 14 induced an electrical signal in each of igniter leading wires 17 coupled to a transformer core, the signal induced therein actuating the resistive ignition element 16 electrically connected thereto.

In accordance with the arrangement of FIG. 3, ignition assemblies including ignition element 16 and igniter leading wires 17 are constructed as a single unit as in the first embodiment so that in field use, the loop end of igniter leading wire 17 need only be slipped over a transformer core 14 to make the assembly ready for use. The user can then loop as many transformer cores 14 as necessary together with a loop 22 of continuous insulated wire that is then coupled to firing cable 12.

By way of nonlimitive example, a specific arrangement is described: Nine resistive electric ignition elements 16 are arranged as shown in FIG. 3, each group of three ignition elements 16 is coupled to a transformer core 14 having a movable portion 15. Loop 22 is a one meter length of 0.61 mm. diameter copper wire insulated with polyvinyl chloride to an outside diameter of 1.14 mm. Loop 22 is connected directly to firing cable 12 which in turn is coupled to firing unit 11. The specific characteristic of ignition element 16, cores 14, firing cable 12, and firing unit 11 are the same as stated in the specific example related to the embodiment shown in FIG. 1. All nine detonators are simultaneously fired by a single signal from firing unit 11.

Therefore it is apparent that there has been provided an apparatus and an arrangement for firing resistive electric ignition elements of the type commonly used in detonators and other pyrotechnic or explosive devices. There has further been provided a safe method for coupling an electrically actuable igniter to a supply of electrical firing energy which does not involve making wire-to-wire connections and wherein external leading wires are insulated at all times to promote safety. There has further been provided a method of constructing ignition assemblies that are easy to utilize in conjunction with applicant's entire system at a field location such ignition assemblies being, by virtue of their design, easy and safe to handle and use.

The ignition system includes an electrically actuable igniter, and source of elecrtical firing energy, a transformer having a core providing a close magnetic circuit, and leading wires from the source of electrical firing energy and from the igniter coupled through the transformer. An insulated portion of the leading wires is looped through the transformer core to form at least a portion of the transformer winding. Preferably, the insulation of the leading wires is continuous over the entire length of the wires in order to avoid accidental exposure to extraneous electrical sources.

A method of assembling electrically actuable ignition assemblies is provided for firing the igniter from a pulse electrical supply. The igniter leading wires are coupled through a transformer to supply conductor wires, the transformer having a core providing a closed magnetic circuit and at least a portin of the transformer winding being constituted by an insulated portion of the igniter leading wires and/or the supply conductor wires looped into the magnetic circuit.

In addition, a method of firing electrically actuable igniters is provided wherein leading wires from the igniter are coupled to leading wires from the firing unit through a transformer having a core providing a closed magnetic circuit. At least a portion of the windings of the transformer or constituted by an insulated portion of the leading wires from the igniter and/or the supply looped into the magnetic circuit.

Obviously, other embodiments and modifications of the present invention will readily come to those of ordinary skill in the art having the benefit of the teachings presented in the foregoing description and the drawings. It is, therefore, to be understood that this invention is not to be limited thereto and that said modifications and embodiments are intended to be included within the scope of the appended claims.

For example, in a specific design, the transformer (or transformers) in the assembly can be used either as a step-up or step-down transformer by appropriate adjustment of the number of turns of the supply and igniter leading wires looped into the magnetic circuit. The transformer core can have any desired configuration and cross-sectional shape but conventional shapes such as toroidal, circular or rectangular configuration with rectangular cross-sections, are readily available. The core material should be a high permeability ferrite material.

The transformer characteristics can be chosen so that alternating current at line power frequencies of 50–60 Hz. will not induce sufficient energy within the transformer to fire an igniter. The transformer should be chosen to transmit the required firing energy when the primary current is provided at 1–10 kHz. from a pulsed supply.

The igniter leading wires can be those used in conventional igniter devices, for example, 0.5 to 1.22 mm. diameter copper or iron wires insulated with a synthetic plastics material, such as polyvinyl chloride. The electrical supply leading wires from the firing cable may be similar to the igniter leading wires or could be a heavier gauge wire, or multi-strand wire.

The invention is applicable to all the commonly used igniters, and in particular those used in electric fuseheads of blasting detonators, the preferred brigewire fusehead resistances being in the range of 0.5–1.6 ohms and having sensitivities in the range of 3–16 (millijoules/ohms.)

What is claimed and desired to be secured by Letters Patent of the United States is:

1. An electrically actuatable ignition assembly comprising:

a resistive electric ignition element within a casing and having two electrical connection terminals within the casing; and a continuous length of insulated electrically conductive wire having its two ends electrically connected to said two terminals of the electric ignition element to form a continuous electrical circuit therebetween and extending outside of the casing without any exposed uninsulated wire joint outside of the casing, a portion of the continuous length of wire providing a loop adapted for electromagnetic coupling to a transformer core.

2. An electrically actuable ignition assembly as in claim 1 further comprising a magnetically permeable transformer core having a winding of at least one turn thereon formed from a section of said continuous length of wire.

3. An electrically actuable ignition assembly as in claim 2 wherein said transformer core is physically openable to admit loops or windings of wire thereto.

4. An electrically actuable ignition assembly as in claim 2 or 3 further comprising a primary winding linking said transformer core for connection to a source of electrical energy.

5. An electrically actuable ignition assembly as in claim 2 or 3 comprising a plurality of said resistive electric ignition elements and respectively corresponding connected continuous lengths of insulated wires magnetically linked to said transformer core.

6. An electrically actuable ignition assembly as in claim 4 comprising a plurality of said transformer cores, each having at least one of said resistive electric ignition elements magnetically linked thereto by a corresponding connected continuous length of insulated wire and wherein said primary winding simultaneously linksall said transformer cores.

7. An igniter for the firing of an electric detonator comprising:

a transformer core;

a primary winding wrapped on said transformer core for coupling to a power source; and at least one single turn secondary winding for coupling to said detonator forming a continuous electromagnetic circuit from said primary winding to said detonator, the detonator being an electric ignition element within a casing and having two electrical connection terminals within the casing and wherein the secondary winding is a continuous length of wire having its two ends coupled to the two terminals forming a continuous electrical circuit therebetween and being insulated outside of the casing and does not have any exposed uninsulated wire joints.

8. The igniter of claim 7 wherein said transformer core includes at least one segment which is movable so that the magnetic circuit of said core can be made or broken by moving said movable segment into or out of magnetic contact with the remaining segment of said core.

9. The igniter of claim 8 including a plurality of secondary windings, coupled one each to a plurality of such detonators.

10. An ignition system for the firing of an electric detonator comprising:

a power supply;

a transformer core;

a primary winding wrapped on said transformer core coupled to saidpower supply; and at least one single turn secondary winding wrapped on said transformer core for coupling to said detonator to be fired, forming a complete electromagnetic circuit from said power supply to aid detonator, the detonator being an electric ignition element within a casing and having two electrical connection terminals within the casing and wherein the secondary winding is a continuous length of wire having its two ends coupled to the two terminals forming a continuous electrical circuit therebetween and being insulated outside of the casing and does not have any exposed uninsulated wire joints.

11. The ignition system of claim 10 wherein said transformer core includes at least one segment which is movable such that the magnetic circuit of said core can be made or broken by moving said movable segment into or out of magnetic contact with the remaining segment of said core.

12. The ignition system of claim 11 including a plurality of secondary windings coupled one each to a plurality of such detonators.

13. An igniter for the firing of an electric detonator comprising:

a transformer core;

a primary winding wrapped on said transformer core for coupling to a power source;

a magnetic ring-core;

a winding wrapped on said magnetic ring-core for electromagnetically coupling to said detonator to be fired said detonator including an electric ignition element within a casing and having two electrical connection terminals within the casing and wherein the winding is a continuous length of wire having its two ends coupled to said two terminals forming a continuous electrical circuit therebetween and being insulated outside of the casing and does not have any exposed uninsulated wire joints; and means for electromagnetically coupling said ring-core to said transformer core, forming a continuous electromagnetic circuit from said primary winding to said detonator to be fired.

14. The igniter of claim 13 wherein said means for electromagnetically coupling is a loop of wire passing through said ring-core and said transformer core.

15. The igniter of claim 13 including a plurality of ring-cores coupled on each to a plurality of detonators.

16. An ignition system for the firing of an electric detonator comprising:

a power supply;

a transformer core;

a primary winding wrapped on said transformer core coupled to said power supply;

magnetic ring-core;

a winding wrapped on said magnetic ring-core for electromagnetically coupling to said detonator said detonator including an electric ignition element within a casing and having two electrical connection terminals within the casing and wherein the winding is a continuous length of wire having its two ends coupled to said two terminals forming a continuous electrical circuit therebetween and being insulated outside of the casing and does not have any exposed uninsulated wire joints; and means for electromagnetically coupling said ring-core to said transformer core, forming a continuous electromagnetic circuit from said power supply to said detonator to be fired.

17. The ignition system of claim 16 wherein said means for electromagnetically coupling is a loop of wire passing through said ring-core and said transformer core.

18. The igniter of claim 16 including a plurality of ring-cores coupled with each to a plurality of detonators.

19. An igniter for the firing of an electric detonator comprising:

a transformer core;

at least one winding wrapped on said core coupled to said detonator said detonator including an electric ignition element within a casing and having two electrical connection terminals within the casing and wherein the winding is a continuous length of wire having its two ends coupled to said two terminals forming a continuous electrical circuit therebetween and being insulated outside of the casing and does not have any exposed uninsulated wire joints; and means for electromagnetically coupling said transformer core to a power source so as to form a complete electromagnetic circuit from said power source to said detonator.

20. The igniter of claim 19 wherein said means for electromagnetically coupling is a loop of wire coupled to said power source and passing through said transformer core.

21. The igniter of claim 19 including a plurality of windings coupled one to each other to a plurality of detonators.

22. The igniter of claim 19 including a plurality of transformer cores.

23. The igniter of claim 22 including a plurality of windings on each of said cores for coupling one each to a plurality of detonators to be fired.

24. The igniter of claim 19 wherein said transformer core has at least one segment that is movable such that the magnetic circuit of said core can be made or broken by moving said movable segment into or out of magnetic contact with the remaining segment of said core.

25. An electrically actuable ignition assembly comprising:

a resistive electric ignition element within a casing having two electrical connection terminals within the casing;

a continuous length of insulated electrically conductive wire having its two ends electrically connected to said two terminals of said resistive electric ignition element and having no uninsulated wire joints outside of the casing; and an ignition assembly magnetically permeable core having a winding of at least one turn thereon formed from a section of said continuous length of wire.

26. An electrically actuable ignition assembly as in claim 25 further including:

a magnetically permeable transformer core; and means for electromagnetically coupling said ignition assembly magnetically permeable core to said magnetically permeable transformer core.

27. An electrically actuable ignition assembly as in claim 26 including a plurality of resistive electric ignition elements and respective corresponding connected continuous wire and respective corresponding ignition assembly magnetically permeable cores electromagnetically coupled to said magnetically permeable transformer core.

28. An electrically actuable ignition assembly as in claim 26 or 27 wherein said means for electromagnetically coupling said ignition assembly magnetically permeable core to said magnetically permeable transformer core is a continuous length of electrically conductive wire.

29. An electrically actuable ignition assembly as in claim 26 further including a primary winding linking said transformer core for connection to a source of electrical energy.

30. A method for constructing an ignition assembly for the firing of an electrically actuable igniter comprising the steps of:

providing an electrically actuable igniter comprising an igniter element within a casing and having two electrical connection terminals within the casing;

electrically coupling the two ends of a continuous length of insulated wire to the two terminals of an electrically actuable igniter such that there are no uninsulated wire joints outside of the casing; and forming a loop in the continuous length of wire.

31. A method for constructing an ignition assembly for the firing of an electrically actuable igniter comprising the steps of:

providing an electrically actuable igniter comprising an igniter element within a casing and having two electrical connection terminals within the casing;

looping a continuous length of insulated wire about a toroidal core; and electrically coupling the two ends of the insulated wire to the two electrical connection terminals of the electrically actuable igniter such that there are no uninsulated wire joints outside of the casing.

32. A method for firing a detonator having a resistive electric ignition element within a casing and having two electrical connection terminals within the casing comprising the steps of:

electrically connecting the two electrical connection terminals of the resistive electric ignition element to the two ends of a continuous length of insulated electrically conductive wire the wire being free of any uninsulated wire joints outside of the casing;

electromagnetically coupling the continuous length of insulated electrically conductive wire to a transformer core; and electromagnetically coupling the transformer core to a source of electrical firing energy.

33. A firing method according to claim 32 wherein said electrically connecting step includes electrically connecting a plurality of resistive electric ignition elements to a plurality of continuous lengths of insulated electrically conductive wire.

34. A firing method according to claim 33 wherein said step of magnetically coupling includes magnetically coupling a plurality of continuous lengths of electrically conductive wire, each such length of wire connected to a resistive electric ignition element, to a transforer core.

35. A method of firing a detonator having an electrically actuable resistive electric ignition element within a casing having two electrical connection terminals within the casing comprising the steps of:

electrically connecting the two electrical connection terminals of the resistive electric ignition element to the two ends of a continuous length of insulated electrically conductive wire the wire being free of any uninsulated wire joints outside of the casing;

magnetically coupling the continuous length of wire to an ignition assembly magnetically permeable core;

magnetically coupling the ignition assembly magnetically permeable core to a transformer core; and electromagnetically coupling the transformer core to a source of electrical firing energy.

36. A firing method according to claim 35 wherein said step of electrically connecting includes electrically connecting a plurality of resistive electric ignition elements to a plurality of continuous lengths of insulated wire.

37. A firing method according to claim 36 wherein said step of magnetically coupling the continuous length of wire includes magnetically coupling a plurality of continuous lengths of wire, each such length electrically connected to an igniter, one each to a plurality of ignition assembly magnetically permeable cores.

38. A firing method according to claim 37 wherein said step of magnetically coupling the ignition assembly core includes magnetically coupling a plurality of ignition assembly cores to a transformer core.

39. A firing method according to claim 33 wherein said step of magnetically coupling includes magnetically coupling groups of pluralities of continuous lengths of wire, each such length of wire connected to a resistive electric ignition element, to a plurality of transformer cores, one such group to each such transformer core.

40. A firing method according to claim 39 wherein said step of electromagnetically coupling includes electromagnetically coupling all such transformer cores to a source of electrical firing energy.

41. A method of firing an electrically actuable ignition assembly including a resistive electric ignition element coupled to both ends of a continuous length of insulated electrically conductive wire, said method comprising the steps of:

opening the magnetic circuit of a transformer core by mechanically moving a leg of the transformer out of contact with the remaining portion of the core to create an opening in said core;

magnetically coupling the ignition assembly to the transformer core by slipping a loop of the continuous length of wire around the transformer core via the opening created by said opening step; and electromagnetically coupling the transformer core to a source of electrical firing energy.

42. A firing method according to claim 41 wherein said magnetically coupling step includes magnetically coupling a plurality of ignition assemblies to a transformer core.

43. A firing method according to claim 42 wherein said opening step includes opening the magnetic circuit for a plurality of transformer cores and said step of magnetically coupling includes magnetically coupling groups of a plurality of ignition assemblies to the plurality of cores.

44. A method for firing an electrically actuable ignition assembly including a detonator having a resistive electric ignition element within a casing coupled to both ends of a continuous length of insulated electrically conductive wire the wire being free from any uninsulated wire joints outside of the casing and being electromagnetically coupled to an ignition assembly magnetically permeable core, said method comprising the steps of:

electromagnetically coupling the ignition assembly core to a transformer core; and electromagnetically coupling the transformer core to a source of electrical firing energy.

45. A firing method according to claim 44 wherein said step of electromagnetically coupling the ignition assembly core to a transformer core includes electromagnetically coupling a plurality of ignition assembly cores to the transformer core.

* * * * *